US005409326A

United States Patent [19]

Ku

[11] Patent Number: 5,409,326

[45] Date of Patent: Apr. 25, 1995

[54] PROCESS FOR PLANTING A ROW OF CEMENT PILES ON THE BED OF A RIVER

[75] Inventor: Chun-I Ku, Kaohsiung Hsien, Taiwan, Prov. of China

[73] Assignees: Chou-Shiang Ku; Chao-Wen Ku, Taiwan, Prov. of China

[21] Appl. No.: 290,609

[22] Filed: Aug. 15, 1994

[51] Int. Cl.[6] ..... E02D 13/04; E02D 11/00

[52] U.S. Cl. ..... 405/228; 405/114; 405/232; 405/275

[58] Field of Search ..... 405/14, 33, 114, 228, 405/232, 256, 275, 267, 286

[56] References Cited

U.S. PATENT DOCUMENTS

| | | | |
|---|---|---|---|
| 942,653 | 12/1909 | Louque | 405/256 |
| 1,034,277 | 7/1912 | Mueser | 405/275 |
| 1,083,570 | 1/1914 | Victor | 405/275 |
| 1,371,709 | 3/1921 | Stockfleth | 405/114 |
| 4,102,147 | 7/1978 | Jansz | 405/228 |
| 4,189,256 | 2/1980 | Dawson | 405/232 |

FOREIGN PATENT DOCUMENTS

| | | | |
|---|---|---|---|
| 2656940 | 6/1978 | Germany | 405/276 |
| 168816 | 9/1985 | Japan | 405/275 |

*Primary Examiner*—Randolph A. Reese
*Assistant Examiner*—Frederick L. Lagman
*Attorney, Agent, or Firm*—Lockwood Alex FitzGibbon & Cummings

[57] ABSTRACT

A process for planting a row of cement piles on the bed of a river includes the steps of (1) placing a vertical guide member of a U-shaped cross-section on the bed, the guide member including two parallel side plates having a width larger than that of the side surfaces of the piles, and a web interconnecting the side plates, the web having a vertical lower section and an inclined upper section; (2) sliding downward the first cement pile over the inner surface of the web until the first cement pile is planted on the bed; (3) inserting downward the second the cement pile into a space between the inclined upper section of the web and the first cement pile; (4) pushing downward the second cement pile, until the second cement pile is planted on the bed, with the result that the guide member is impelled by the second cement pile to move to a position which is in line with the first and second cement piles, and that a vertical coupler hole is defined between the tongues of the second cement pile and between the grooves of the first cement pile; and (5) planting sequentially remainder of the cement piles by repeating the steps (3) and (4).

1 Claim, 6 Drawing Sheets

PROCESS FOR PLANTING A ROW OF CEMENT PILES ON THE BED OF A RIVER

BACKGROUND OF THE INVENTION

1. Field of the Invention

This invention relates to a process for planting a row of cement piles on the bed of a river, more particularly to an improved process which is capable of tidily planting the row of cement piles on the bed of the river so as to minimize the clearance between each pair of the piles, thereby preventing the soil of the river, which is located downstream of and in the proximity of the piles, from being washed away, when in flood.

2. Description of the Related Art

It is necessary to plant a row of cement piles upstream of and in the proximity of the portion of a levee, which is to be adjusted or repaired. Referring to FIGS. 1 and 2, a conventional process to plant a row of cement piles on a bed of a river 21 includes the following steps: (1) hoisting and inserting a first cement pile 1 into the bed 21 of the river by means of a crane 2, the bottom end of the pile 1 being tapered in order to be easily inserted into the bed 21 of the river; (2) hoisting a second cement pile 1' and moving the bottom end portion 11 of the same to abut against the top end portion 12 of the first cement pile 1; (3) depressing the second cement pile 1' to insert the lower portion of the same into the bed 21 of the river; (4) planting a third cement pile 1'' on the bed 21 of the river in the same manner as the second cement pile 1'; and (5) planting the rest of the cement piles on the bed 21 of the river one by one in the same manner as the third cement pile 1''.

As a result, a relative large clearance 211 is formed between each adjacent pair of the cement piles 1, 1', 1'' due to the fact that the piles 1, 1', 1'' are usually inclined, causing water flow through the clearances 211. This water flow reduces the water blocking effect of the row of piles 1, 1', 1''.

SUMMARY OF THE INVENTION

Therefore, the object of this invention is to provide an improved process for tidily and efficiently planting a row of cement piles on the bed of the river in such a manner that the clearance between any adjacent pair of the piles is minimized and that the piles are interconnected firmly.

According to this invention, a process is provided for planting a row of cement piles on the bed of a river. Each of the cement piles has a tapered lower end portion and two generally parallel trapezoid side surfaces each of which has a short vertical side, a long vertical side, a horizontal upper side interconnecting the upper ends of the short and long vertical sides, and an inclined lower side interconnecting the lower ends of the short and long vertical sides. Each of the cement piles further has a short engagement surface defined between the short vertical sides of the trapezoid side surfaces, and a long engagement surface defined between the long vertical sides of the trapezoid side surfaces. Each of the cement piles includes two parallel vertical tongues projecting from one of the short and long engagement surfaces thereof, and two parallel vertical grooves formed in the other of the long and short engagement surfaces thereof and aligned with said two parallel vertical tongues respectively.

The process includes a first step which is to place a vertical guide member of a U-shaped cross-section on the bed. The guide member includes two parallel side plates having a width larger than that of the side surfaces of the piles, and a web interconnecting the side plates. Each of the side plates and the web has a horizontal lower side. The lower sides of the side plates and the web are at the same level. The web has a vertical lower section and an upwardly and outwardly inclined upper section having a lower end coupled with the upper end of the vertical lower section. The web has a width slightly larger than those of the short and long engagement surfaces of the piles.

The second step is to slide downward the short engagement surface of a first cement pile over the inner surface of the web of the guide member until the first cement pile is planted on the bed, so that the upper end of the first cement pile is above the upper end of the guide member.

The third step is to insert downward the tapered lower end portion of a second cement pile into a space between the inclined upper section of the web of the guide member and the first cement pile so as to contact the long engagement surface of the second cement pile with the short engagement surface of the first cement pile, and so as to engage the tongues of one of the first and second cement piles within the grooves of the other of the first and second cement piles.

The fourth step is to push downward the second cement pile so as to slide downward the long engagement surface of the second cement pile over the short engagement surface of the first cement pile, and so as to slide downward the short engagement surface of the second cement pile over the inner surface of the web of the guide member, until the second cement pile is planted on the bed, with the result that the guide member is impelled by the second cement pile to effect a horizontal displacement equal to width of the side surfaces of the cement piles, and that a vertical coupler hole is defined between the first and second ones of the cement piles and between the tongues of one of the first and second cement piles and between the grooves of the other of the first and second cement piles.

The remainder of the cement piles is planted sequentially on the bed of the river by repeating the third and fourth steps.

BRIEF DESCRIPTION OF THE DRAWING

Other features and advantages of this invention will become apparent in the following detailed description of the preferred embodiment of this invention, with reference to the accompanying drawings, in which.

DETAILED DESCRIPTION OF THE PREFERRED EMBODIMENT

Figure 1:
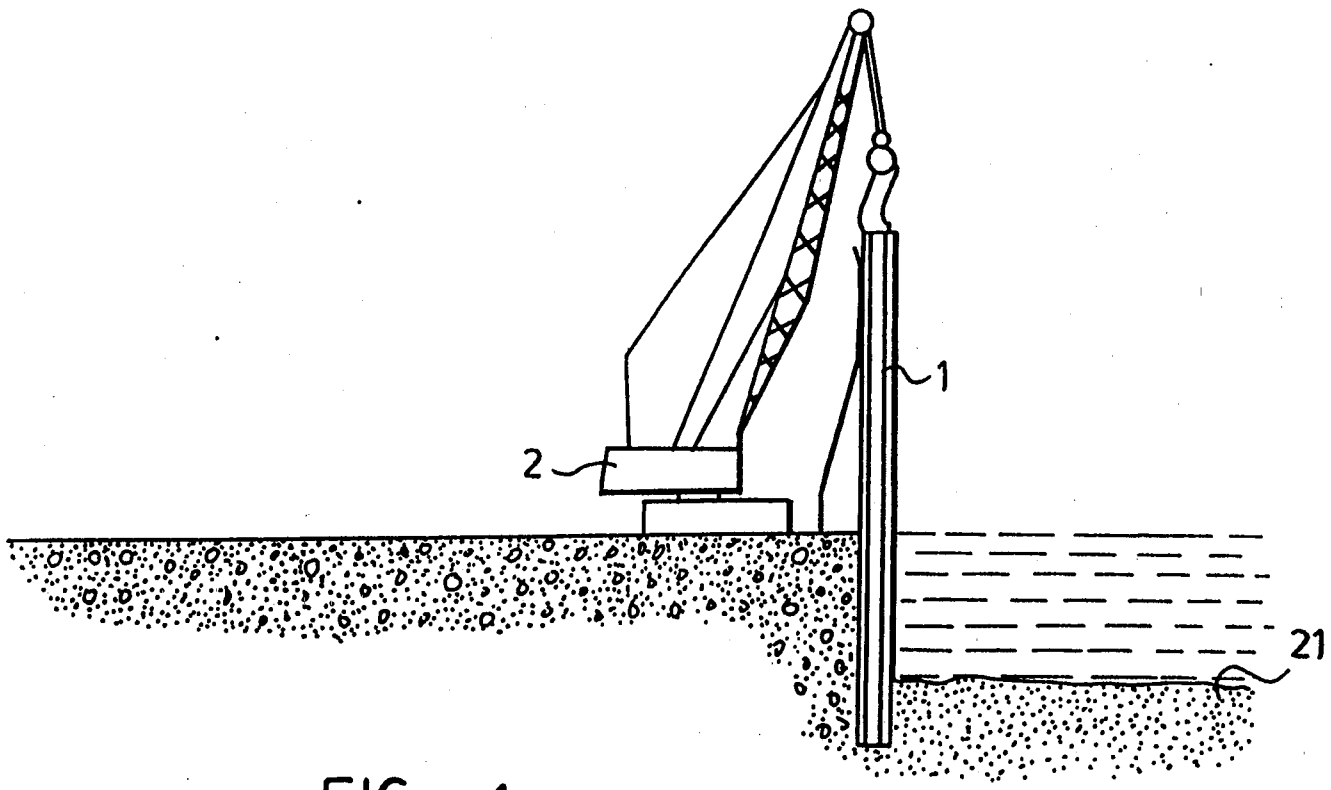
FIG. 1 PRIOR ART
FIG. 1 is a schematic view illustrating how the first one of a row of cement piles is planted on the bed of a river by a crane in a known manner.
Figure 2:
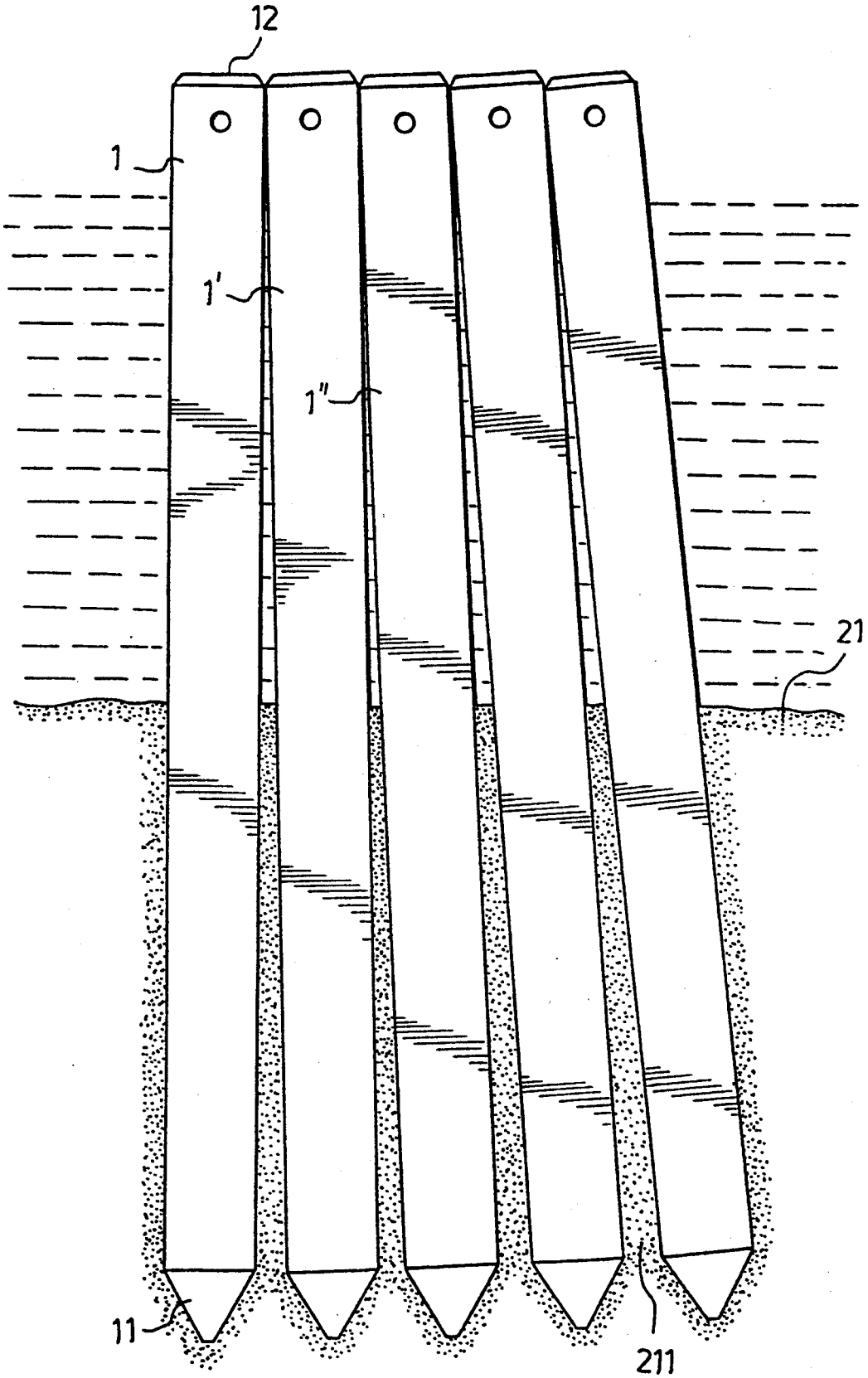
FIG. 2 PRIOR ART
FIG. 2 is a schematic view illustrating a row of cement piles which are planted on the bed of a river in a known manner.
Figure 3:
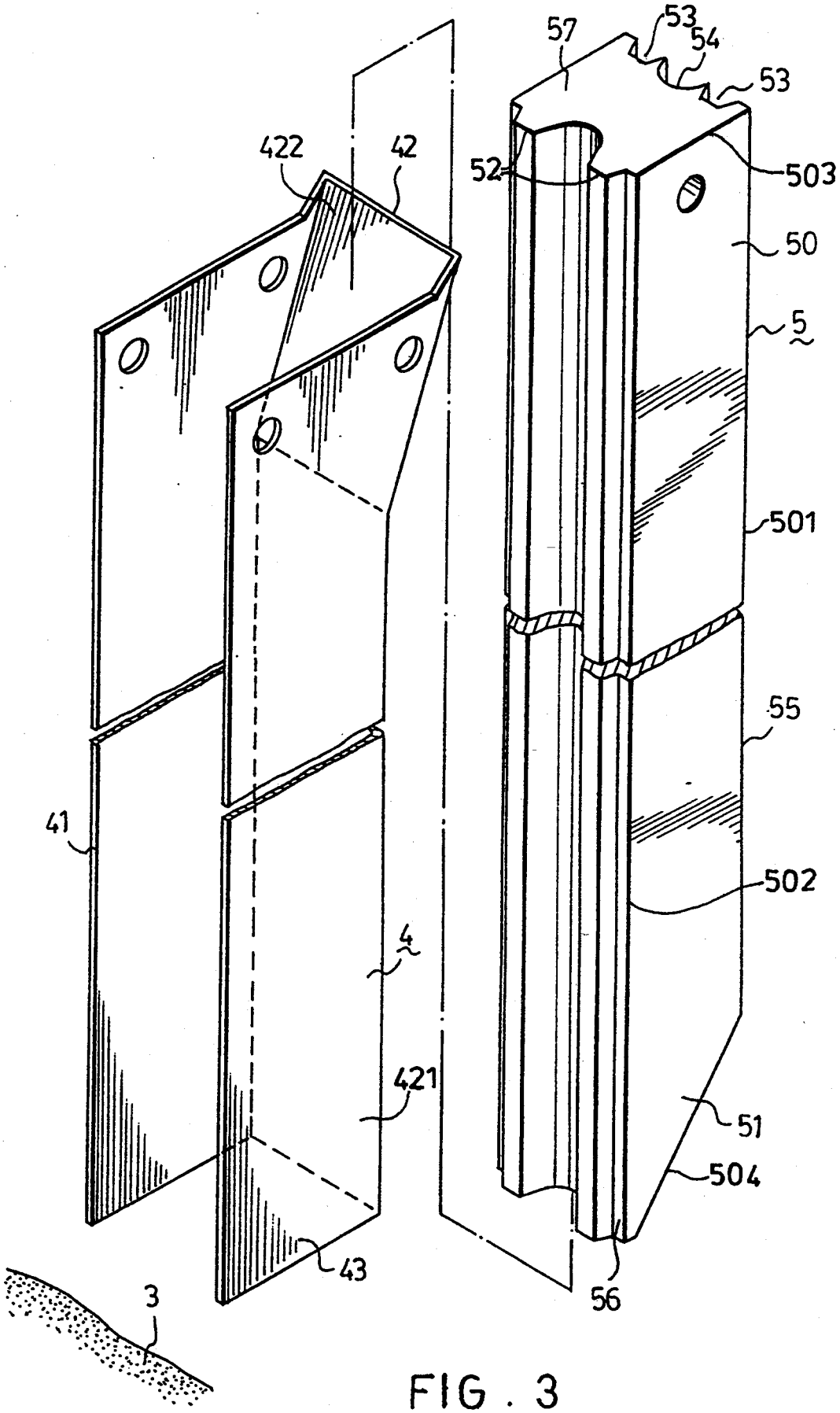
FIG. 3 is a perspective view showing a cement pile and a guide member which are used in a process for planting a row of the cement piles on the bed of a river in accordance with this invention.

Referring to FIG. 3, a process of this invention is provided for planting a row of cement piles 5, 5', 5" (see FIG. 4) on the bed 3 of a river and includes a first step which is to place a vertical guide member 4 of a U-shaped cross-section on the bed 3. The second step is to slide downward the first cement pile 5 over the inner surface of the web 42 of the guide member 4 until the first cement pile 5 is planted on the bed 3, so that the upper end of the first cement pile 5 is located at the position shown in FIG. 4, which is above the upper end of the guide member 4.

The first cement pile 5 has two generally parallel trapezoid side surfaces 50 and a tapered lower end portion 51. Each of the trapezoid side surfaces 50 has a short vertical side 501, a long vertical side 502, a horizontal upper side 503 interconnecting the upper ends of the short and long vertical sides 501, 502, and an inclined lower side 504 interconnecting the lower ends of the short and long vertical sides 501, 502. The first cement pile 5 further includes two parallel vertical tongues 52, two parallel trapezoid grooves 53 and a semicircular central groove 54. The short vertical sides 501 of the trapezoid side surfaces 50 define therebetween a short engagement surface 55 in which the grooves 53, 54 are formed. The long vertical sides 502 of the trapezoid side surfaces 50 define therebetween a long engagement surface 56 from which the tongues 52 project in alignment with the trapezoid grooves 53. The top surface 57 of the first cement pile 5 is horizontal. The remainder of the cement piles 5', 5" is similar to the first cement piles 5 in construction.

As illustrated, the guide member 4 includes two parallel side plates 41, 43 having a width larger than that of the side surfaces 50 of the first cement pile 5, and a web 42 interconnecting the side plates 41, 43. Each of the side plates 41, 43 and the web 42 has a horizontal lower side. The lower sides of the side plates 41, 43 and the web 42 are at the same level. The web 42 has a vertical lower section 421 and an upwardly and outwardly inclined upper section 422 having a lower end coupled with the upper end of the vertical lower section 421. The web 42 has a width slightly larger than those of the short and long engagement surfaces 55, 56 of the cement pile 5.

Figure 4:
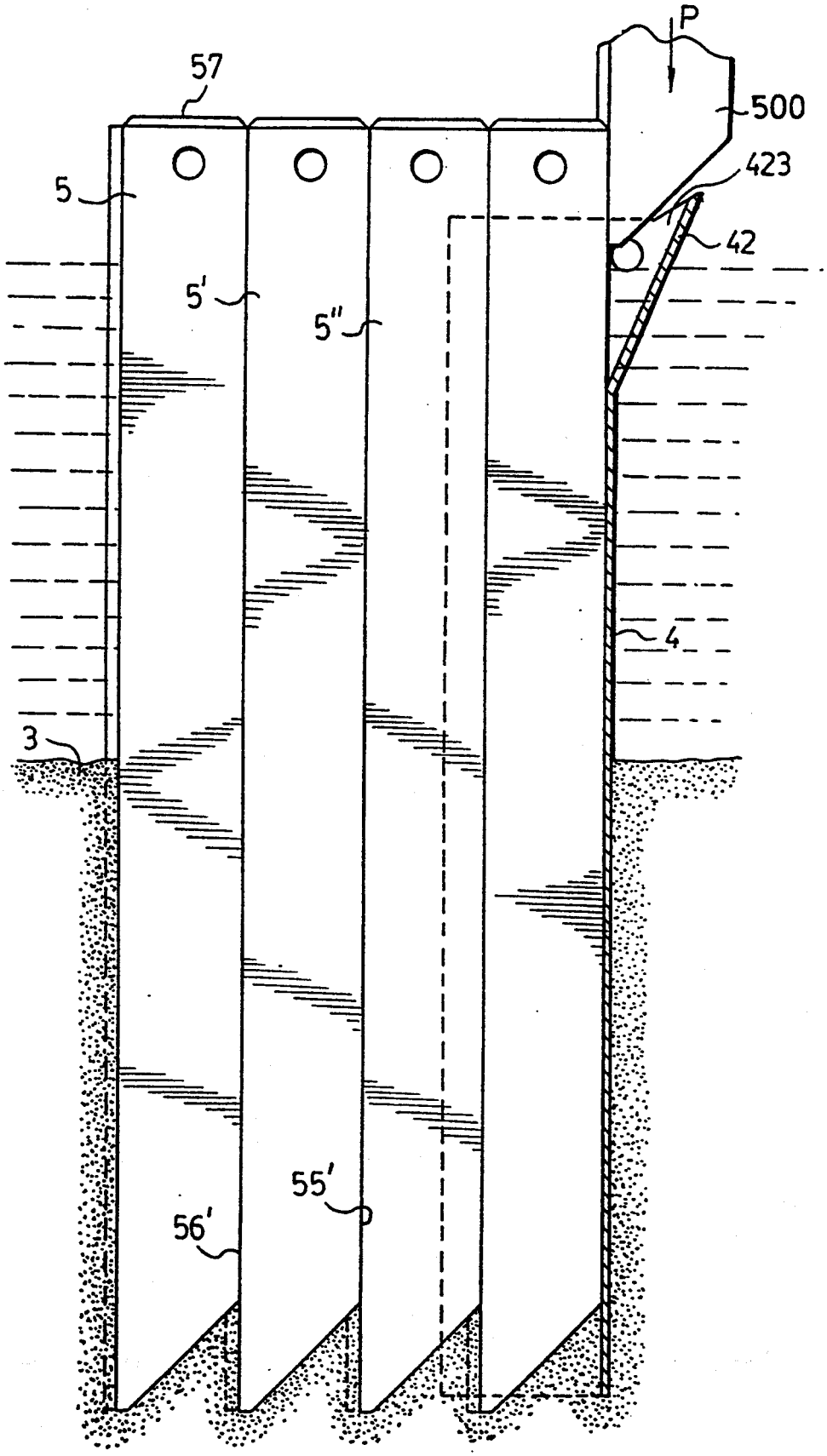
FIG. 4 is a schematic view illustrating how the fifth cement pile is inserted into the guide member in the process of this invention.
Figure 5:
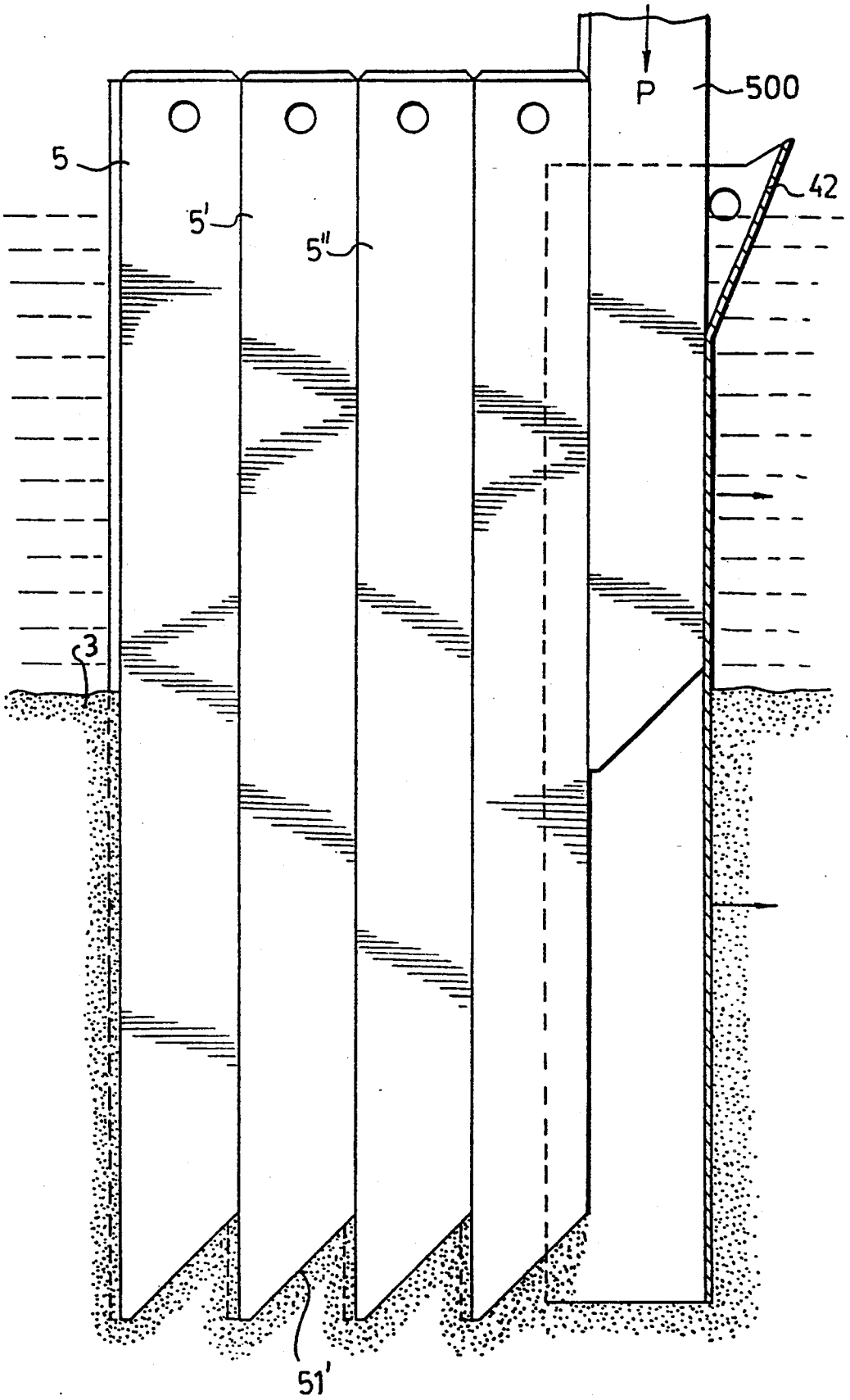
FIG. 5 is a schematic view illustrating how the fifth cement pile is depressed to move the guide member in a horizontal direction in the process of this invention.
Figure 6:
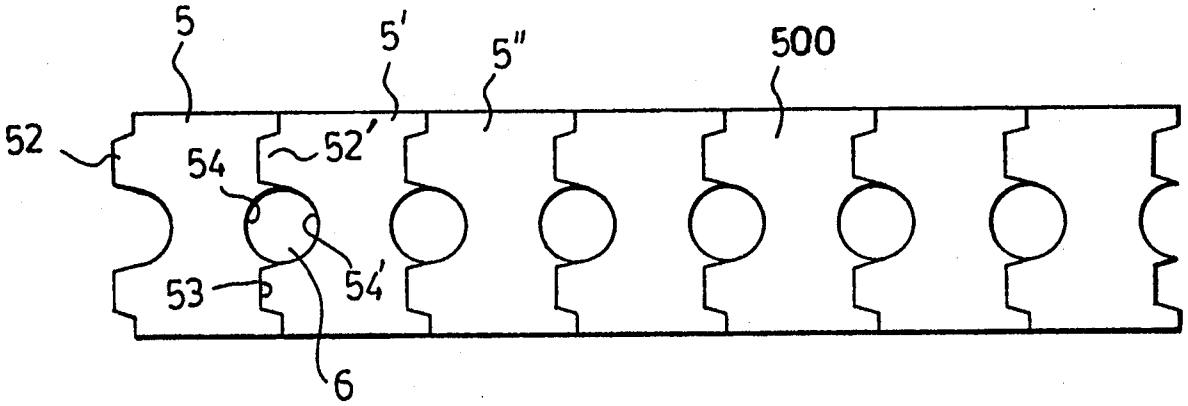
FIG. 6 is a top view showing the row of cement piles which are planted on the bed of the river in accordance with this invention.

FIGS. 4, 5 and 6 illustrate how a fifth cement pile 500 is planted on the bed 3 of the river by applying a downward force (P) thereto. As best shown in FIG. 4, in a situation where the inner surface of the vertical lower section 421 (see FIG. 3) of the web 42 of the guide member 4 abuts against a cement pile, a space 423 is defined between the inclined upper section 422 of the web 42 and the cement pile.

After the first cement pile 5 has been put in position, the remainder of the row of the cement piles 5', 5" is planted on the bed 3 of the river in the same manner as the fifth cement pile 500. In this way, the third step is to insert the tapered lower end portion of the second cement pile 5' into a space 423 between the inclined upper section 422 of the web 42 of the guide member 4 and the first cement pile 5 so as to contact the long engagement surface 56' of the second cement pile 5' with the short engagement surface 55 of the first cement pile 5, and so as to engage the tongues 52' of the second cement pile 5' within the grooves 53 of the first cement pile 5.

The fourth step is to push downward the second cement pile 5' so as to slide downward the long engagement surface 56 of the second cement pile 5' over the short engagement surface 55 of the first cement pile 5, and so as to slide downward the short engagement surface 55' of the second cement pile 5' over the inner surface of the web 42 of the guide member 4, until the tapered lower end portion 51' (see FIG. 5) of the second cement pile 5' is inserted into the bed 3. As a result, the guide member 4 is impelled by the second cement pile 5' to effect a horizontal displacement equal to width of the side surfaces 50 of the first cement pile 5 due to the fact that the side plates 41, 43 of the guide member 4 has a width larger than that of the side surfaces 50 of the first cement pile 5. At this time, the first and second cement piles 5, 5' and the guide member 4 are in a line. Accordingly, the semicircular central grooves 54, 54' of the first and second cement piles 5, 5' together constitute a vertical coupler hole 6 of a circular cross-section which is defined between the first and second cement piles 5, 5' and between the tongues 52' of the second cement pile 5' and between the grooves 53 of the first cement pile 5 in order to fill concrete within the coupler hole 6 so as to secure the first and second cement piles 5 and 5' together. It can be appreciated that when the long engagement surface 56' of the second cement pile 5' slides downward over the short engagement surface 55 of the first cement pile 5, sands or the like can be removed from the short engagement surface 55 so as to achieve intimate joint between the first and second cement piles 5, 5'. Similarly, sands or the like between the short engagement surface 55' of the second cement pile 5' and the third cement pile 5" can be minimized.

With this invention thus explained, it is apparent that numerous modifications and variations can be made without departing from the scope and spirit of this invention. It is therefore intended that this invention be limited only as indicated in the appended claims.

I claim:

1. A process for planting a row of cement piles on the bed of a river, each of the cement piles having a tapered lower end portion and two generally parallel trapezoid side surfaces each of which has a short vertical side, a long vertical side, a horizontal upper side interconnecting upper ends of the short and long vertical sides, and an inclined lower side interconnecting lower ends of the short and long vertical sides, each of the cement piles further having a short engagement surface defined between the short vertical sides of the trapezoid side surfaces, and a long engagement surface defined between the long vertical sides of the trapezoid side surfaces, each of the cement piles including two parallel vertical tongues projecting from one of the short and long engagement surfaces thereof, and two parallel vertical grooves formed in the other of the long and short engagement surfaces thereof and aligned with said two parallel vertical tongues respectively, the process comprising the steps of:

(1) placing a vertical guide member of a U-shaped cross-section on the bed, the guide member including two parallel side plates having a width larger than that of the side surfaces of the piles, and a web interconnecting the side plates, each of the side plates and the web having a horizontal lower side, the lower sides of the side plates and the web being at the same level, the web having a vertical lower section and an upwardly and outwardly inclined upper section having a lower end coupled with an upper end of the vertical lower section, the web having a width slightly larger than those of the short and long engagement surfaces of the piles;

(2) sliding downward the short engagement surface of a first one of the cement piles over an inner surface of the web of the guide member until the first one of the cement piles is planted on the bed, so that an upper end of the first one of the cement piles is above an upper end of the guide member;

(3) inserting downward the tapered lower end portion of a second one of the cement piles into a space between the inclined upper section of the web of the guide member and the first one of the cement piles so as to contact the long engagement surface of the second one of the cement piles with the short engagement surface of the first one of the cement piles, and so as to engage the tongues of one of the first and second ones of the cement piles within the grooves of the other of the first and second ones of the cement piles;

(4) pushing downward the second one of the cement piles so as to slide downward the long engagement surface of the second one of the cement piles over the short engagement surface of the first one of the cement piles, and so as to slide downward the short engagement surface of the second one of the cement piles over the inner surface of the web of the guide member, until the second one of the cement piles is planted on the bed, with the result that the guide member is impelled by the second one of the cement piles to effect a horizontal displacement equal to width of the side surfaces of the cement piles, and that a vertical coupler hole is defined between the first and second ones of the cement piles and between the tongues of one of the first and second ones of the cement piles and between the grooves of the other of the first and second ones of the cement piles; and (5) planting sequentially remainder of the cement piles on the bed of the river by repeating the steps (3) and (4).

* * * * *